US006865912B2

(12) United States Patent
Kim

(10) Patent No.: US 6,865,912 B2
(45) Date of Patent: Mar. 15, 2005

(54) WASHING MACHINE

(75) Inventor: Kyeong Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 10/438,214

(22) Filed: May 15, 2003

(65) Prior Publication Data

US 2004/0123632 A1 Jul. 1, 2004

(30) Foreign Application Priority Data

Dec. 27, 2002 (KR) ..... 10 2002-0085103
Dec. 27, 2002 (KR) ..... 10 2002-0085105

(51) Int. Cl.[7] ..... D06F 37/02
(52) U.S. Cl. ..... 68/133; 68/23 R; 68/131
(58) Field of Search ..... 68/131, 133, 134, 68/23 R, 23.6

(56) References Cited

U.S. PATENT DOCUMENTS 2,645,111 A * 7/1953 Fields ..... 68/23.6
2,831,333 A * 4/1958 Smith ..... 68/131
5,460,018 A * 10/1995 Werner et al. ..... 68/23.6
5,791,167 A * 8/1998 Wyatt et al. ..... 68/134
6,064,389 A * 5/2000 Berry et al. ..... 345/419
6,115,863 A * 9/2000 Mason et al. ..... 8/159
6,227,013 B1 * 5/2001 Wyatt-Smith ..... 68/134

* cited by examiner

*Primary Examiner*—Frankie L. Stinson
(74) *Attorney, Agent, or Firm*—Greenblum & Bernstein, P.L.C.

(57) ABSTRACT

A washing machine is disclosed, in which a structure of transmitting power to a wobbler is improved. The outer tub is provided in a cabinet, an inner tub rotatably provided in the outer tub, and the wobbler is provided in the inner tub. A cylindrical dehydration shaft passes through the outer tub, and is connected to a bottom of the inner tub, and a wash shaft passes through inside of the dehydration shaft and the bottom of the inner tub. A motor rotates the wash shaft in a direction or in an opposite direction. A clutch assembly, operated according to a signal of a control unit, selectively transmits rotating force of the wash shaft to the dehydration shaft. A rotation guide having a flat section in spiral form is projected on the upper end of the wash shaft. An inclined shaft has a top end being coupled to the wobbler and a bottom end being supported by an inner circumferential surface of the guide, and rotates the bottom end of the inclined shaft about a center axis of the wash shaft and wobbling the wobbler during the rotation of the wash shaft. Guiding means supports the inclined shaft and guides the rotation of the inclined shaft.

18 Claims, 8 Drawing Sheets

WASHING MACHINE

CROSS-REFERENCE TO RELATED APPLICATIONS

This application claims the benefit of Korean Application No. P2002-85103, and No. P2002-85105 both filed on Dec. 27, 2002, which are hereby incorporated by reference as if fully set forth herein.

BACKGROUND OF THE INVENTION

1. Field of the Invention

The present invention relates to a washing machine, and more particularly, to a washing machine with a wobbler that engages washing by wobbling in an inner tub of the washing machine.

2. Discussion of the Related Art

Generally, a washing machine is an apparatus performing processes of wash, rinse and dehydration so as to remove contaminants from clothes by using action of detergent and water. Such a washing machine is classified into drum, agitator, and pulsator type.

A simple washing mechanism of a drum washing machine is as follows. The drum washing machine being provided with a drum having a plurality of projected tumbling ribs performs a washing process by slowly and horizontally rotating the drum with detergent, washing water, and laundries in it. In this way, in the drum washing machine, the washing is performed by action of detergent and impact being generated as laundries are raised and dropped by the tumbling ribs.

On the other hand, in the agitator and the pulsator washing machine, washing is performed by the action of detergent and friction of water current, generated by rotating the agitator or pulsator projected in the middle of the washing machine. Such agitator and pulsator washing machines have advantages of excellent washing efficiency and large loading capacity.

Hereinafter, a general structure of the pulsator washing machine is explained in reference to FIG. 1. An outer tub 3 is provided in a cabinet 1 for storing water, and an inner tub 5 is rotatably provided in the outer tub 3. A supporter 2, both ends of which connected to the cabinet 1 and the outer tub 3, supports the outer tub 3. On an outer surface of the inner tub 5 is formed a plurality of holes 5*a* through which wash water passes between the outer tub 3 and the inner tub 5. A pulsator 7 is rotatably provided in the middle of an inside of the inner tub 5. And, a motor 9 is provided for rotating the inner tub 5 and the pulsator 7.

A structure of power transmission from the motor 9 to the inner tub 5 and the pulsator 7 is explained in more detail. A dehydration shaft 15 passing through the lower part of the outer tub 3 is coupled to the inner tub 5, and a wash shaft 13 is provided to pass through the inside of the dehydration shaft 15. The upper part of the wash shaft 13 is coupled to the pulsator 7 and the lower part of the motor 9 is connected to the motor 9.

On the other hand, the wash shaft 13 and the dehydration shaft 15 is usually serration-combined, and rotating force of the wash shaft 13 is selectively transmitted to the dehydration shaft 15 by a clutch assembly 11 operated by a signal of a control unit (not illustrated).

The following is a description about operation of the washing machine with said structure. The inner tub 5 is supplied with wash water when the washing machine is operated after laundries are putted in the inner tub 5. After the wash water supply is completed, the pulsator 7 generates water current by rotating in a direction and an opposite direction. And, washing is performed by the friction between laundries by the pulsator 7 and the current of water, and the action of detergent.

The wash water is drained after the washing is performed for a predetermined time. After the inner tub is supplied with clean water, laundries are rinsed by rotation of the pulsator 7, and the rinse water is drained.

Laundries are dehydrated after said rinse process is repeated several times. In the dehydration process, the wash shaft 13 and the dehydration shaft 15 are connected with each other by the operation of clutch assembly 11, and the rotating power of wash shaft 13 is transmitted to the dehydration shaft 15. Hence, at this time, the pulsator 7 and the inner tub 5 rotate with each other in high speed, and water in laundries is discharged from the washing machine after separated by the centrifugal force.

In a conventional washing machine operated as said, laundries are not only twisted with each other but also damaged because washing is performed by water current generated from the rotation of the pulsator 7 installed in the same direction of the center axis of the inner tub 5 in the state laundries are soaked in wash water.

That is, the conventional washing machine has problems that the effectiveness of washing machine is lowered and the reliability of product is deteriorated in the end in that energy is not concentrated on washing but used to twist and damage laundries.

SUMMARY OF THE INVENTION

Accordingly, the present invention is directed to a washing machine with a wobbler that substantially obviates one or more problems due to limitations and disadvantages of the related art.

An object of the present invention is to provide a washing machine having an improved power transmission structure in which rotation of a motor is changed to a wobbling movement of a wobbler to perform washing with up-and-down oscillation movement for preventing laundries from being jammed.

Additional advantages, objectives, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a washing machine according to the present invention includes a cabinet, an outer tub, an inner tub, a wobbler, a wash shaft, a dehydration shaft, a motor, a clutch assembly, a rotation guide, an inclined shaft, and guide means.

The cabinet forms an exterior, and the outer tub is provided in the cabinet. The inner tub is rotatably provided in the outer tub, and the wobbler is provided in the inner tub. The dehydration shaft in a cylindrical form passes through the outer tub and is coupled to a hub, the wash shaft is provided to pass through an inside of the dehydration shaft and the bottom of the inner tub. The motor rotates the wash shaft in a direction or an opposite direction. The clutch assembly is operated by a signal of a control unit, and selectively transmits rotating force of wash shaft 140 to the dehydration shaft 150. The rotation guide 170 having a flat section in spiral form is projected at the upper end of the wash shaft 140. The inclined shaft has a top end being coupled to the wobbler 500 and a bottom end being supported by an inner circumferential surface of the rotation guide 170, the guide rotating the bottom end of the inclined shaft 200 about a center of the wash shaft and wobbling the wobbler 500 during the rotation of the wash shaft. The guiding means supports the inclined shaft 200 and guides a rotating movement of the inclined shaft 200. At each end of the rotation guide 170, a first stopper 172 and a second stopper 171 are bended toward the inner circumferential surface and extended to both ends of the rotation guide.

The inclined shaft 250 includes an eccentric shaft having a small diameter relative to the inclined shaft, the eccentric shaft extending eccentrically to a center axis of the inclined shaft 200 at the lower end of the inclined shaft 200, having an end being in contact with and being supported by the inner surface of the rotation guide, and guiding the rotation of the inclined shaft. The inclined shaft 200 includes an expansion unit 240 having a diameter greater than that of the inclined shaft, the expansion unit being provided at the bottom of the inclined shaft.

The washing machine includes a bearing being provided between the top end of the inclined shaft and the wobbler for preventing friction there-between and preventing the end of the inclined shaft and the wobbler from rotating with each other. On the other hand, in the washing machine according to the present invention, the inner tub includes an inclined shaft guide being provided at a lower inside of the inner tub, the inclined shaft passing through the inclined shaft guide, which limits an inclination angle of the inclined shaft. The inclined shaft includes a boss being provided around an outer surface of the inclined shaft, and being in contact with an inside surface of the inclined shaft guide to limit the inclination angle of the inclined shaft. Also, an inner circumferential surface of the inclined shaft guide has an inner circumferential surface such that a bottom circumference of the inner circumferential surface is greater than a top circumference of the inner circumferential surface. The inclined angle of the inclined shaft is in a range of 1°–10° with respect to the center axis of the wash shaft.

In the first embodiment of the present invention, the guiding means includes a wobbler guide in a bowl form provided around the outer circumferential surface of the inclined shaft, and a lower part guide provided in a lower inside of the inner tub, the lower part guide supporting a bottom surface of the wobbler guide and guiding the rotation of the inclined shaft. The lower part guide, having a spherical surface for guiding the rotation of the inclined shaft smoothly, includes a guiding surface attached to the bottom surface of the wobbler guide.

In the second embodiment of the present invention, the guiding means further includes an upper guide provided in a lower inside of the inner tub, the upper guide having a bottom surface in a bowl form to guide an upper surface of the wobbler guide and having a center through-hole, through which the inclined shaft passes. Here, an upper surface of the upper guide is in a spherical form remaining a predetermined minimal distance with the circumferential end of the wobbler during wobbling of the wobbler for preventing laundries from being jammed.

Meanwhile, the third embodiment of the present invention has a similar structure to the second embodiment of the present invention. Supporter and the inclined shaft guide are not provided in the second embodiment of the present invention, the lower part guide plays the roles of the supporter and the inclined shaft guide. For that, the lower part guide has a hole with a small diameter, a hole through which the inclined shaft guide passes, and an inner circumferential surface of the lower part guide has an inner circumferential surface such that a bottom circumference of the inner circumferential surface is greater than a top circumference of the inner circumferential surface.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
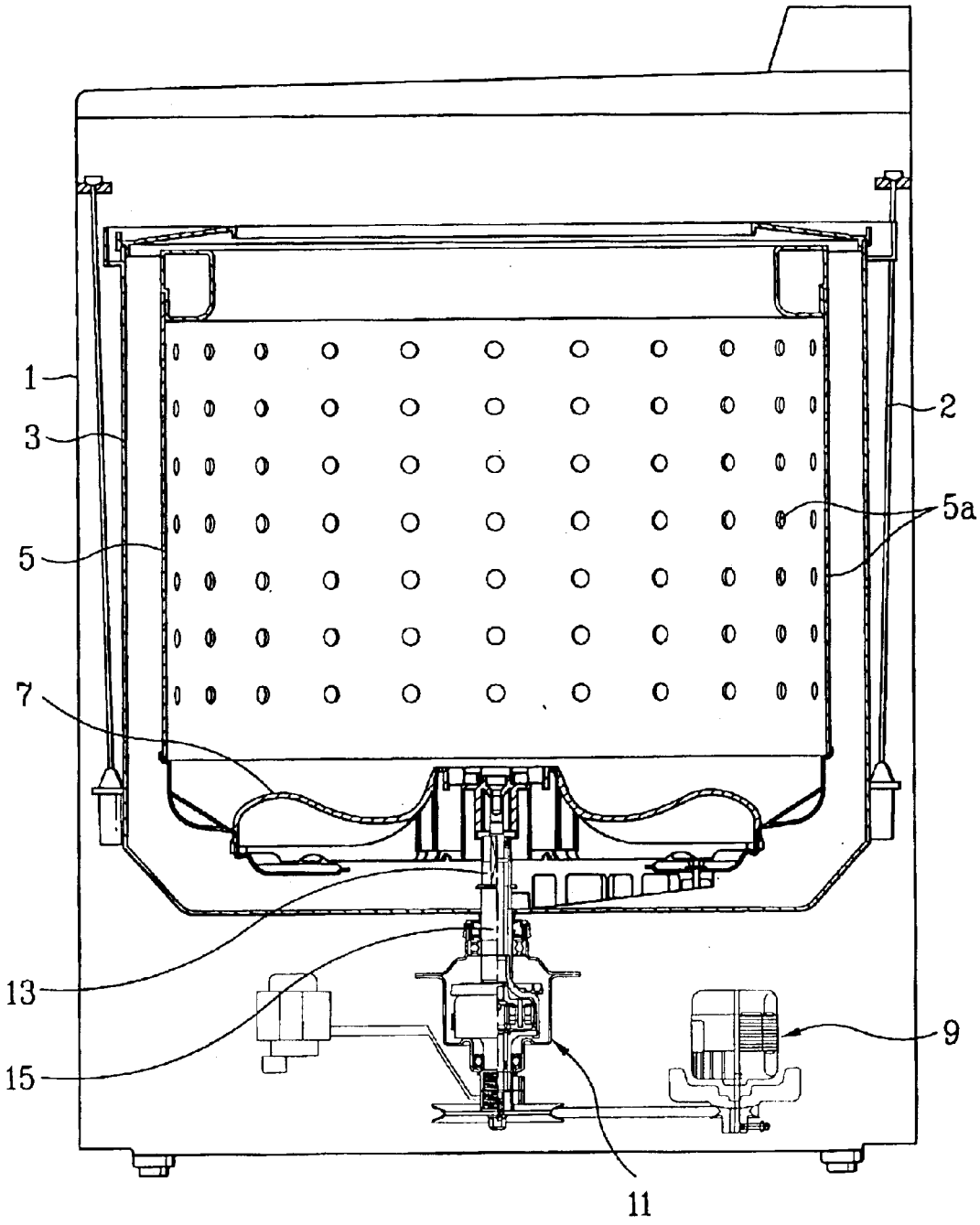
FIG. 1 illustrates a cross-sectional view of a structure of a general pulsator type washing machine.
Figure 2:
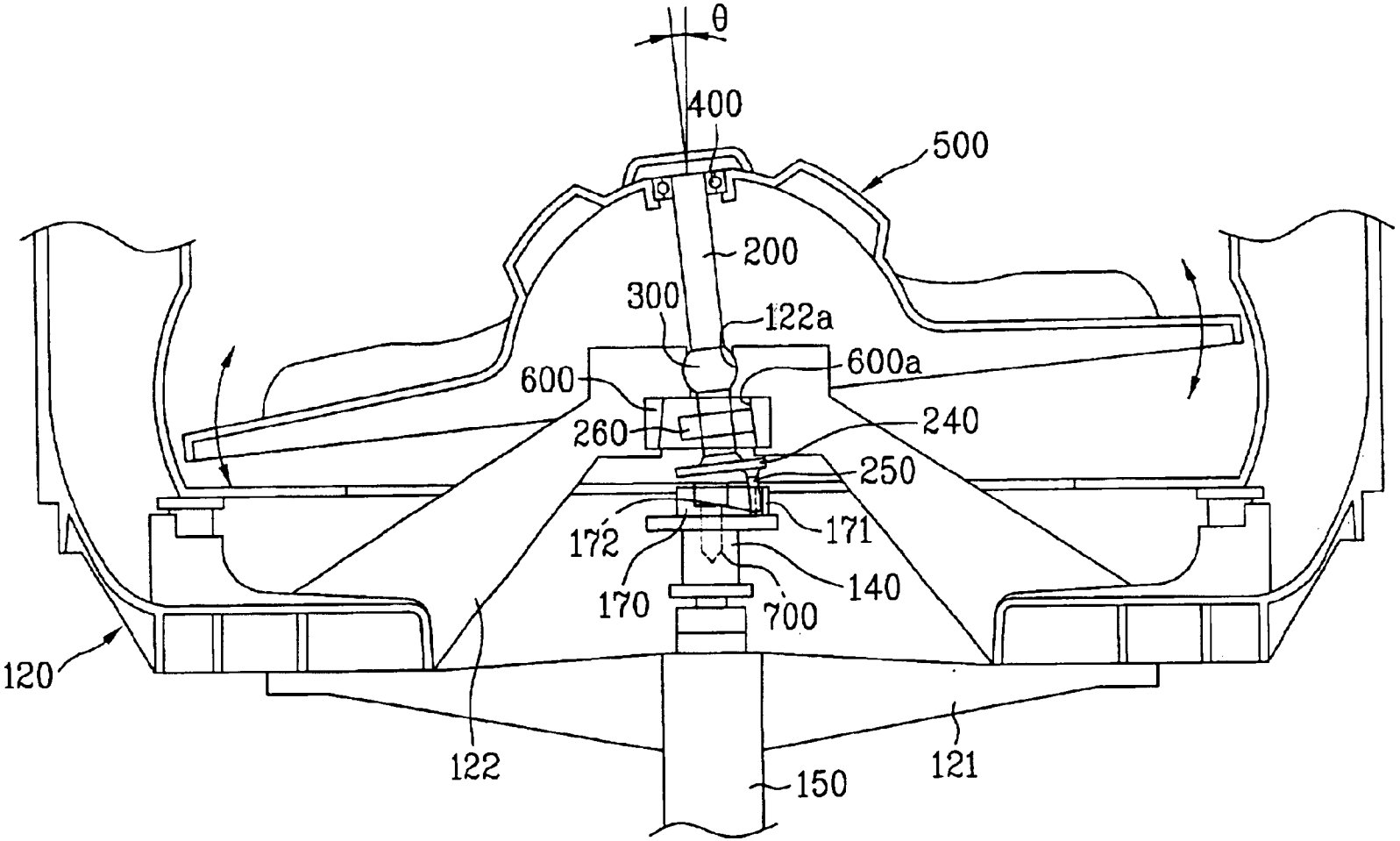
FIG. 2 illustrates a cross-sectional view of an inclined wobbler according to a first embodiment of the present invention.
Figure 3:
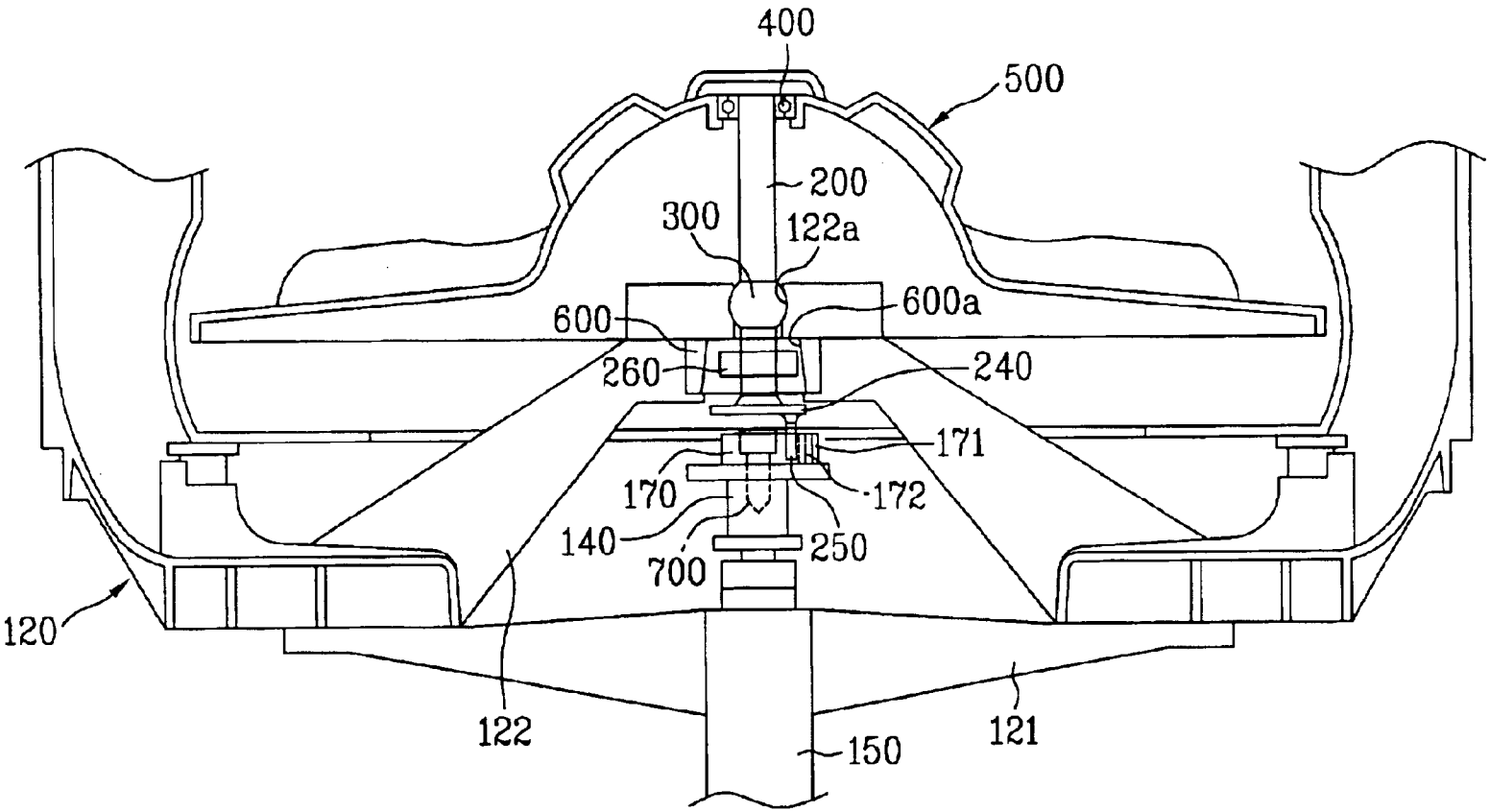
FIG. 3 illustrates a cross-sectional view of a horizontal wobbler according to the first embodiment of the present invention.
Figure 4:
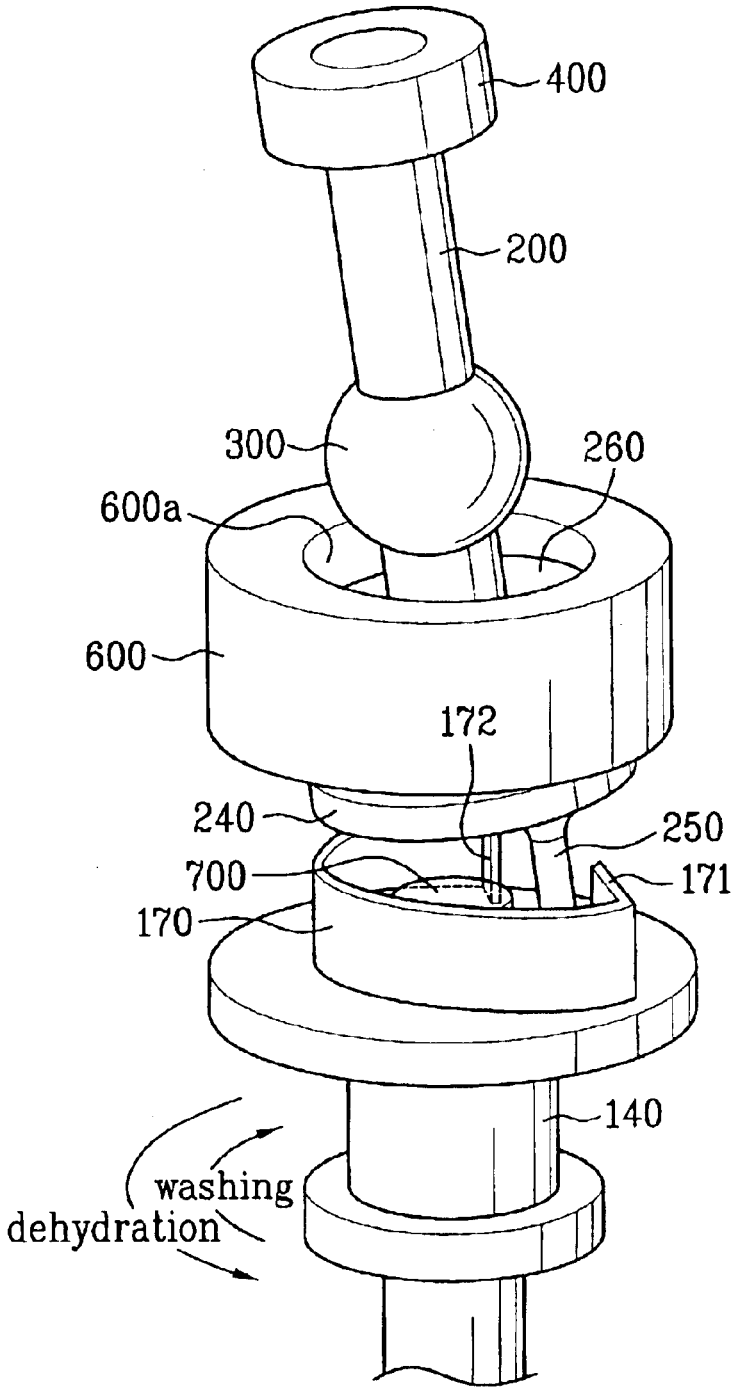
FIG. 4 illustrates a bird-eye view of a combination of an inclined shaft and a wash shaft according to the first embodiment of the present invention.

FIG. 2 to FIG. 4 illustrates the characteristics of a first embodiment of the present invention. Composition of the present invention will be explained according to a first embodiment of the present invention with reference to the drawings. In reference, a general structure of a washing machine such as structural elements of a conventional washing machine, being referenced by FIG. 1, is omitted.

Referring to the drawings, the first embodiment of the present invention includes a cabinet, an outer tub, an inner tub 120, a wobbler 500, a wash shaft 140, a dehydration shaft 150, a motor, a clutch assembly, a rotation guide 170, an inclined shaft 200, and guide means.

The cabinet forms an exterior, and the outer tub is provided to fix in the cabinet. The inner tub 120 is rotatably provided in the outer tub, and the wobbler is provided in the inner tub 120.

The dehydration shaft 150 formed in a cylindrical form with both open ends, passes through the outer tub and is coupled to a hub 121 fixed at a bottom of the inner tub 120 on the same line with the center axis of the inner tub 120.

The wash shaft 140 is provided to pass through an inside of the dehydration shaft 150 and the bottom of the inner tub 120, more specifically, the hub 121 at the bottom of the inner tub 120. The wash shaft 140 is connected to the motor so as to rotate in a direction or an opposite direction.

The clutch assembly (not illustrated) is operated by a signal of a control unit (not illustrated), and selectively transmits rotating force of wash shaft 140 to the dehydration shaft 150. That is, the cultch assembly connects the wash shaft 140 and the dehydration shaft 150 to rotate them together during dehydration, and to rotate the wash shaft 140 by itself during washing. A detailed composition of such a clutch assembly is omitted in this statement because it is the same as that of a general clutch assembly.

The rotation guide 170 having a flat section in spiral form as illustrated in FIG. 4 is projected at the upper end of the wash shaft 140. Explaining this in more detail, when taken a bird's-eye view, an end of the rotation guide 170 is adjacent to a center axis of the wash shaft 140, a middle part of the rotation guide 170 becomes far from the center axis of wash shaft 140 as it goes counter-clockwise and the other end is adjacent to the outer circumferential surface. Such a rotation guide 170 is manufactured from separate pieces, can be coupled by a coupling member 700 such as a bolt at an upper end of washing machine axis 140, and can be formed in one at the upper end of the washing machine axis 140. At each end of the rotation guide 170, a first stopper 172 and a second stopper 171 are bended toward the inner circumferential surface and extended to both ends of the rotation guide.

The inclined shaft has a top end being coupled to the wobbler 500 and a bottom end being supported by an inner circumferential surface of the rotation guide 170, the guide rotating the bottom end of the inclined shaft 200 about a center of the wash shaft and wobbling the wobbler 500 during the rotation of the wash shaft.

Meanwhile, the inclined shaft 200 includes an expansion unit 240 and an eccentric shaft 250. The expansion unit 240 having a diameter greater than that of the inclined shaft is provided at the bottom of the inclined shaft. And, the eccentric shaft 250 is eccentrically extended to the center axis of the inclined shaft 200 at the bottom end of the inclined shaft 200. For example, it is extended on an edge of a bottom surface of the expansion unit 240 extended from the bottom end of the inclined shaft 200. And, the inclined shaft 200 has a diameter greater than that of the eccentric shaft 250. If the inclined shaft 200 has this structure, the eccentric shaft 250 can be formed more eccentrically to the inclined shaft 200.

In the mean time, the outer circumferential surface of the eccentric shaft 250 is in contact with and supported by the inner circumferential surface of the rotation guide 170. And, a gap is maintained between the upper end of the wash shaft 140 and a bottom end of the eccentric shaft 250. On this wise, guiding means is equipped to support the inclined shaft 200 for maintaining a gap between the bottom end of the inclined shaft 200 and the upper end of the wash shaft 140 and to guide a rotating movement of the inclined shaft 200.

The guiding means includes a ball joint 300 and a supporter 122 according to a first embodiment of the present invention. The ball joint 300, a kind of pivot, is expanded in a spherical form on outer circumferential surface of the inclined shaft as illustrated in FIG. 4, and is supported by the supporter 122 of the inner tub 120. The supporter 122 for supporting the ball joint 300 is extended at a bottom of the inner tub 120. And, as illustrated in FIG. 2, the inclined shaft 200 passes through the supporter 122, and the ball joint 300 is supported in contact with the inner circumferential surface of the supporter 122. For this, on the inner circumferential surface of the supporter 122, a spherical support groove 122*a*, each being in contact with the surface of the ball joint, is provided in spherical form so as to support the ball joint 300.

In this composition, the inclined shaft 200 rotates and revolves around the ball joint 300 stably supported by the support groove 122*a* maintaining a gap between a bottom end of the eccentric shaft 250 and the upper end of the wash shaft 140.

On the other hand, the inclined shaft 200 rotates in an inclined position within a range of a predetermined inclination angle according to a first embodiment of the present invention. An inclined shaft guide 600 and a boss 260 are provided to limit the inclination angle of the inclined shaft 200.

The inclined shaft guide 600 is provided at the bottom of the inner tub 120, in more detail, to the supporter 122 at the bottom of the inner tub 120. The inclined shaft guide 600 is formed in a ring form and is provided under the support groove 122*a* as illustrated in FIG. 4. And, the inclined shaft 200 is installed to pass through the inner circumferential surface of the inclined shaft guide 600 as illustrated in FIG. 2.

The boss 260 is extended in a direction of radius at the outer circumferential surface of the inclined shaft 200. The outer circumferential surface of the boss 260 limits the range of the inclination angle in contact with the inner circumferential surface of the inclined shaft guide 600 during a rotation of the inclined shaft 200.

On the other hand, an inner circumferential surface 600*a* of the inclined shaft guide 600 has an inner circumferential surface such that a bottom circumference of the inner circumferential surface is greater than a top circumference of the inner circumferential surface to contact with the boss 260.

The range of the inclination angle of the inclined shaft 200 for rotation during washing is determined by the inclined shaft guide 600 with said structure and the boss 260, in more detail, by the diameter of the boss 260, the inside diameter of the inclined shaft guide 600, and the slope of the inner circumferential surface 600*a* according to a first embodiment of the present invention. The range of the inclined shaft 200 is designed to have a range of 1°–10° with the respect to a vertical axis according to a first embodiment of the present invention.

On the other hand, a bearing 400 is installed at a conjunction of a top end of the inclined shaft 200 and the wobbler 500 to prevent friction and rotating each other between the inclined shaft 200 and the wobbler 500 during wobbling of the wobbler 500. The bearing 400 installed as this is classified into a ball bearing and a journal bearing.

Also, the lower circumferential surface of the inner tub 120 is in spherical form for maintaining a predetermined minimal distance from a circumferential end of the wobbler 500 so as to prevent laundries from being jammed between the circumferential end of the wobbler 500 and the lower circumferential surface of the inner tub 120 during wobbling of the wobbler 500.

The washing machine according to a first embodiment of the present invention, on washing mode of operation, performs washing by applying energy generated from wobbling of the wobbler 500 and the rotation of the inclined shaft 200 to laundries. And, on a dehydration mode of operation, laundries are dehydrated using centrifugal force generated from the rotation of the wobbler 500 and the inner tub 120 in vertical position of the inclined shaft 200. The following is a detailed explanation of the structural elements of a washing and dehydration process related to a transformation of energy.

First of all, a center of gravity of the inclined shaft 200 is eccentric to one side because the eccentric shaft 250 is eccentrically projected from a center axis of the eccentric shaft 250 to one side. Hence, the inclined shaft 200 is inclined to one side with the ball joint 300 as a center axis in a stationary position. On this wise, the inclination angle of the inclined shaft 200 in the stationary state is limited to the angle in the state where outer circumferential surface of the eccentric shaft 250 is supported by the inner circumference side of the rotation guide 170. Like this, if the inclined shaft 200 is inclined in the stationary state, the wobbler 500 connected with the top end of the inclined shaft 200 is inclined together with the inclined shaft 200 as illustrated in FIG. 2.

In this condition, if a user started operating the washing machine on washing mode after putting laundries and supplying water in the inner tub 120, power of the motor is transferred only to the wash shaft 140, and the wash shaft 140 rotates clockwise as illustrated in FIG. 4. At this time, the clutch assembly limits a rotating force of the wash shaft 140 not to be transferred to the dehydration shaft 150.

When the wash shaft 140 starts rotating clockwise, the eccentric shaft 250 at a lower end of the inclined shaft 200 tends to remain at a same place because of inertia, on the other hand, the rotation guide 170 projected at the upper end of the wash shaft 140 with flat section in spiral form rotates clockwise. Like this, if the rotation guide 170 rotates clockwise when the inclined shaft 200 remains stationary, the distance between an end of the eccentric shaft 250 and the inner circumferential surface of the rotation guide 170 gets bigger. Therefore, the inclined shaft 200 inclines more to one side with the ball joint 300 supported by the support groove 122*a* as a center axis until the end of the eccentric shaft 250 is in contact with the inner circumferential surface of the rotation guide 170. Undoubtedly, the wobbler 500 inclines together with the inclined shaft 200.

The inclined shaft 200 inclines at bigger angle as the wash shaft 140 keeps rotating. The outer circumferential surface of the boss 260 is in contact with and supported by the inner circumferential surface of the inclined shaft guide 600, and the inclination angle of the inclined shaft 200 is fixed. The inclined shaft 200 inclines remaining in the stationary state until the inclination angle of the inclined shaft 200 is fixed by the inclined shaft guide 600 and the boss 260.

On the other hand, the second stopper 171 is located at the end of the rotation guide 170, and the eccentric shaft 250 being supported by the second stopper 171 stops rotating when the wash shaft 140 keeps rotating. The inclined shaft 200 rotates together with the wash shaft 140 after the eccentric shaft 250 being supported by the second stopper 171 stops rotating. At this time, each top end of and bottom end of the inclined shaft 200 rotates around the ball joint 300 drawing a furrow that the inclined shaft 200 rotates around the center axis of the wash shaft 140.

Although the inclined shaft 200 rotates in inclined position according to the rotation of the wash shaft 140, the wobbler 500 does not rotate together with the inclined shaft 200 because the inclined shaft 200 and the wobbler 500 are connected with the bearing 400. Only when the inclined shaft 200 continues to rotate around the ball joint 300, the wobbler 500 performs a wobbling movement such that a side of wobbler 500 rises or falls according to the location of the inclined shaft 200. That is, the wobbler 500 does not rotate together with the inclined shaft 200 because the top end of the inclined shaft 200 is connected to an inner race of the bearing 400 and the wobbler 500 is connected to an outer race of the bearing 400. And, the wobbler 500 inclines together with the inclined shaft 200 rotating with the ball joint as a center axis. The wobbler 500 wobbles changing the inclination direction rapidly according to the inclination direction of the inclined shaft 200 that changes the inclination direction quickly. Like this, the wobbler 500 wobbles with high speed, energy such as an impact and a friction is applied to wash water contained in the inner tub 120 and laundries, and washing is performed.

The next, the process of the dehydration after completion of the washing process will be explained. When the washing machine is on the dehydration mode, the clutch assembly operated by the signal of the control unit connects the wash shaft 140 with the dehydration shaft 150. When the wash shaft 140 is connected with the dehydration shaft 150, the rotating force of the motor is transmitted to both the wash shaft 140 and the dehydration shaft 150 so that the wash shaft 140 and the dehydration shaft 150 rotate each other at a same speed. On the other hand, on the dehydration mode, the wash shaft 140 and the dehydration shaft 150 rotate counterclockwise contrary to that on the washing mode.

When the wash shaft operated by the motor 140 starts rotating counterclockwise, the rotation guide 170 on the upper end of the wash shaft 140 rotates counterclockwise together with the wash shaft 140. Meanwhile, the eccentric shaft 250 is connected with the inner surface of the rotation guide 170 when the inclined shaft 200 is in inclined position, and the inclined shaft 200 tends to remain in the stationary state because of inertia.

The rotation guide 170 has a flat section in spiral form and becomes adjacent to the center axis of the inclined shaft 200 when it rotates clockwise. If the rotation guide 170 rotates counterclockwise, the eccentric shaft 250 attached to the inner surface of the rotation guide 170 moves to the center axis of the wash shaft 140 more and more. Hence, the inclination of the inclined shaft 200 becomes gentle as the inclined shaft 200 rotates about the ball joint 300.

On the other hand, the fist stopper 172 is projected on the end of the rotation guide 170. Thus, when the rotation guide 170 rotates, the first stopper 172 supports the eccentric shaft 250. On this wise, in the state the eccentric shaft is supported by the first stopper, the inclined shaft 200 is in a perfect vertical position. The wash shaft 140 is in accordance with the center axis of the inclined shaft 200 thereupon.

As explained above, the inclined shaft 200 being in vertical position by the first stopper 172 and the eccentric shaft 250 rotates at high speed together with the wash shaft 140. At this time, the wobbler 500 remains horizontal. And, the dehydration shaft 150 and the inner tub 120 connected with the dehydration shaft 150 rotate at high speed together with the wash shaft 140, and the moisture contained in laundries in the inner tub 120 is separated and removed from laundries by centrifugal force.

At this time, although the inclined shaft 200 and the wobbler 500 are formed to rotate each other by bearing 400, When wash water in the inner tub 120 is drained, laundries rotate together with the inner tub 120 at high speed and the wobbler 500 at the lower end of the inner tub 120 also rotates at high speed. Therefore, during dehydration, the wobbler 500 rotates together with laundries at high speed, and prevents laundries from being damaged according to a first embodiment of the present invention.

Figure 5:
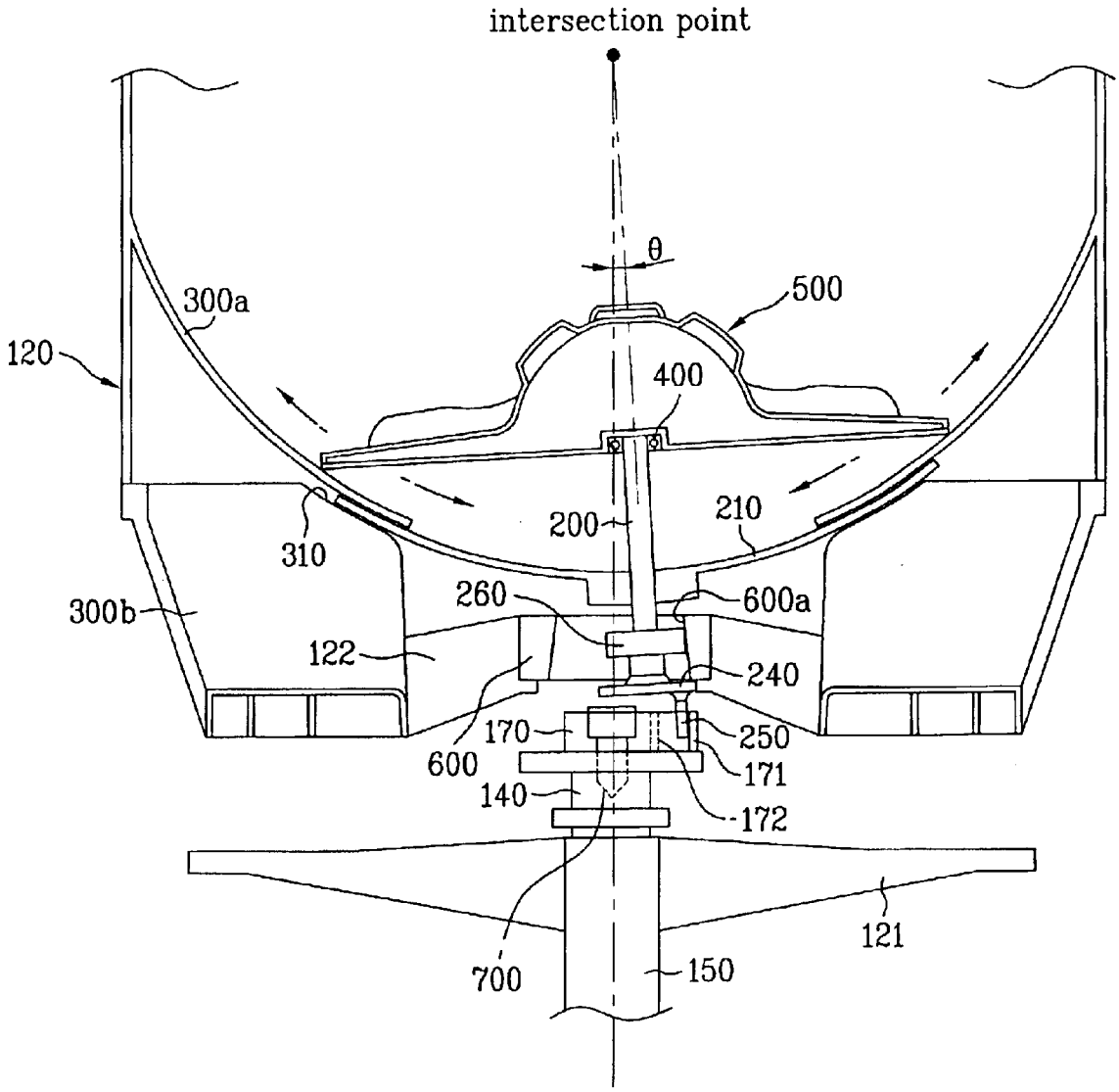
FIG. 5 illustrates a cross-sectional view of an inclined wobbler according to a second embodiment of the present invention.
Figure 6:
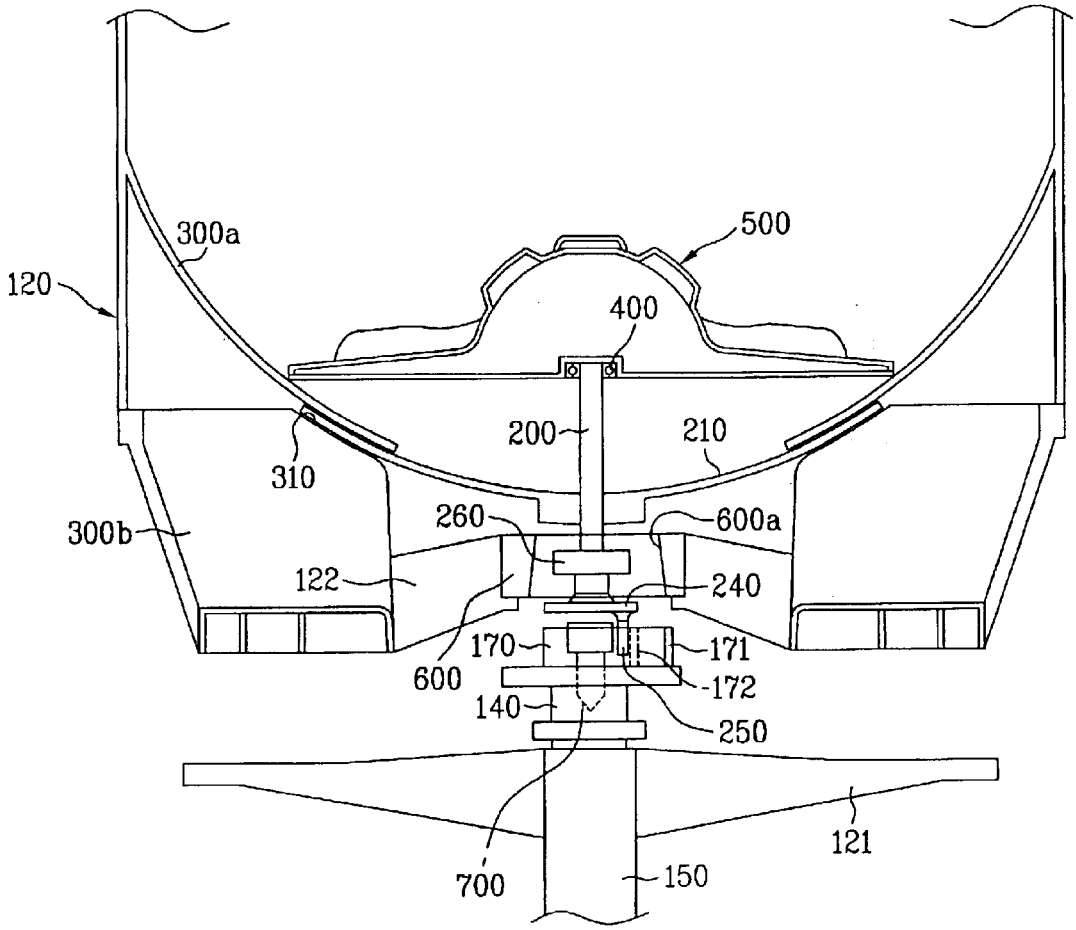
FIG. 6 illustrates a cross-sectional view of a horizontal wobbler according to the second embodiment of the present invention.
Figure 7:
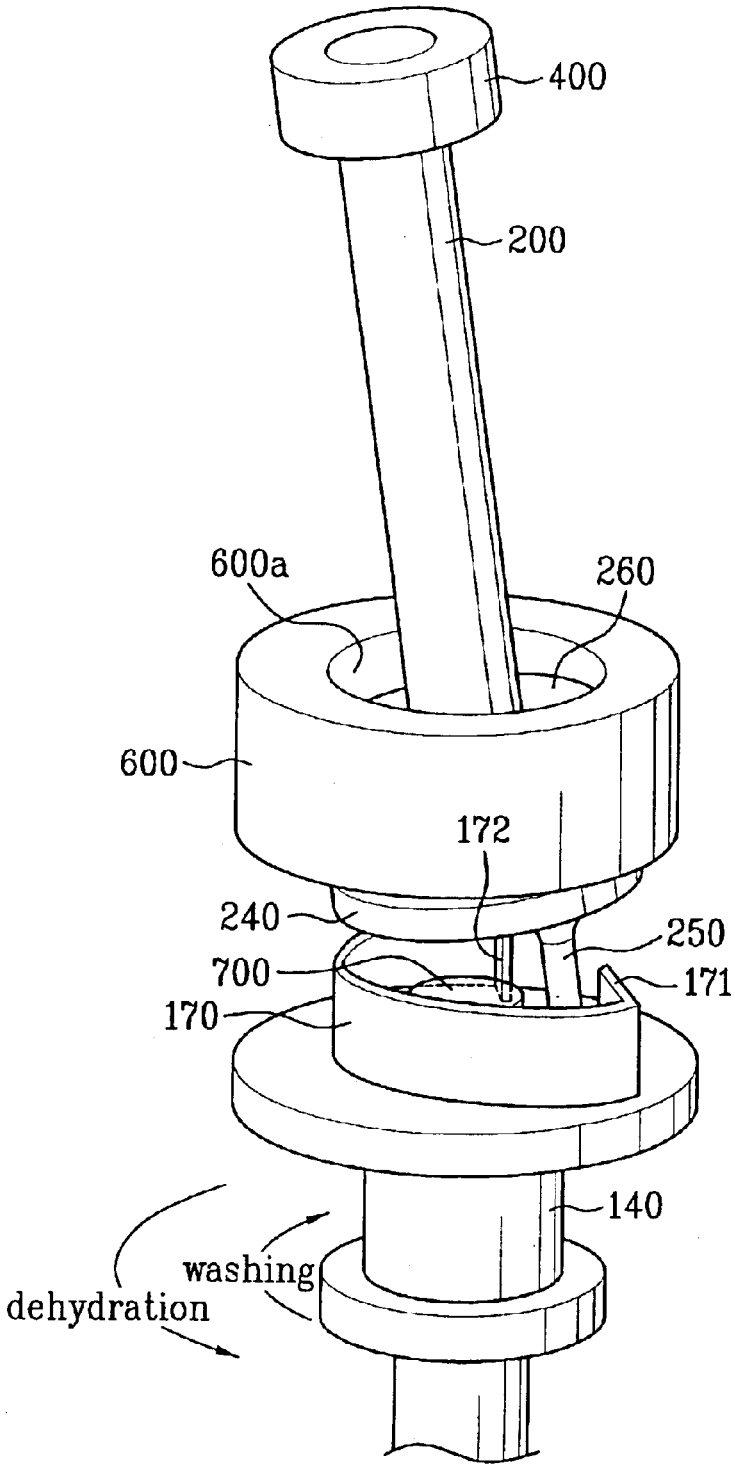
FIG. 7 illustrates a bird-eye view of the combination of an inclined shaft and a wash shaft according to the second embodiment of the present invention.

On the other hand, FIGS. 5–7 illustrate the characteristics of the present invention. The structure of a washing machine in accordance with a second preferred embodiment of the present invention will be explained with reference to these drawings. For a reference, general structural elements of a conventional washing machine described in the drawings will be omitted, and the same parts will be given the same names and symbols in explaining a first embodiment of the present invention referenced by FIGS. 2–4.

As illustrated in FIGS. 5–7, the second embodiment of the present invention has a similar structure to that of the first embodiment of the present invention such that a structure of the first embodiment of the present invention is explained in reference with FIGS. 2–4. And, the following explanation will be concentrated on guiding means having a different structure from the first embodiment of the invention.

Guiding means according to the second embodiment of the present invention is different from guiding means of the first embodiment of the present invention. The guiding means of the first embodiment of the present invention is for guiding the rotation of the inclined shaft 200 rotating around the ball joint 300. On the other hand, guiding means according to the second embodiment of the present invention includes a wobbler guide 210, a top guide 300*a*, and a bottom guide 300*b* for guiding the rotation of the inclined shaft 200. Undoubtedly, the ball joint and the support groove are not provided in the second embodiment of the present invention. Next, guiding means according to the second embodiment of the present invention will be explained in more detail.

The wobbler guide 210 is extended in a bowl form around the outer circumferential surface of the inclined shaft 200 at upper end of the boss 260 as illustrated in FIG. 5. Here, both ends of the bowl are arranged to head up and a convex surface of the bowl to head down.

The bottom guide 300*b* is provided at the bottom of the inner tub 120, and a hole through which the inclined shaft 200 passes is provided in the middle of the bottom guide 300*b*. On the upper surface of the bottom guide 300*b*, is provided a guide surface 310 having a spherical surface in contact with the bottom of the wobbler guide 210 around the hole. The guide surface 310 supports the wobbler guide 210 and guides a smooth rotation of the inclined shaft 200.

A top guide 300*a* having is extended in a bowl form in the inner tub 120 so that a convex surface heads down. The base plane of the top guide 300*a* provided as this guides the upper surface of the wobbler guide 210. And, in the middle of a convex base plane of the top guide 300*a* is provided a through-hole through which the inclined shaft 200 passes. On the other hand, an upper surface of the top guide 300*a* is in a spherical form remaining a predetermined minimal distance with the circumferential surface of the wobbler 500 during a wobbling of the wobbler 500 for preventing laundries from being jammed between the upper surface of the top guide 300*a* and the circumferential surface of the wobbler 500.

If the wobbler guide 210, the top guide 300*a*, and the bottom guide 300*b* are composed of a structure mentioned above, as illustrated in FIG. 5 and FIG. 6, the wobbler guide 210 extended on a circumferential surface moves as inserted between the bottom surface of the top guide 300*a* and the bottom guide 310*b* of the bottom guide 300*b* so as to guide the rotation of the inclined shaft 200.

On the other hand, the inclined shaft guide 600 and the boss 260 are provided to limit the inclination angle of the inclined shaft 200 according to the second embodiment of the present invention. As illustrated in FIG. 2, the inclination guide 600 is provided to the supporter 122 extended from the bottom guide 300*b* at the bottom of the inner tub 120. Here, as illustrated in FIG. 5, the supporter 122 is formed to extend from the inner circumferential surface of the bottom guide 300*b* to reduce space needed for installation to the minimum.

The operation of the second embodiment of the present invention with said structure is as follows. The inclined shaft 200 and the wobbler 500 remain in inclined position with the same principal explained in the explanation of the first embodiment of the present invention.

As illustrated in FIG. 7, only the wash shaft 140 rotates clockwise on washing mode. If the wash shaft 140 rotates clockwise and the inclined shaft 200 and the wobbler 500 are in inclined position, the inclination angle of the inclined shaft 200 and the wobbler 500 becomes bigger, and the inclined shaft 200 rotates together with the wash shaft 140 after the eccentric shaft 250 is supported by the second stopper 171.

When the inclined shaft 200 rotates, the wobbler guide 210 inserted between a guide surface of the bottom guide 300*b* and the top guide 300*a* moves and guides the movement of the inclined shaft 200. At this time, as illustrated in FIG. 5, the inclined shaft 200 rotates around the intersection of an extension line of the center axis of the wash shaft 140 and an extension line of the center axis of the inclined shaft 200.

The wobbler 500 wobbles according to the rotation of the inclined shaft 200, and performs washing by applying energy to wash water and laundries. When the washing machine is changed to the dehydration mode after washing is finished, the wash shaft 140 and the dehydration shaft 150 are connected to each other by the operation of the clutch assembly. The wash shaft 140 and the dehydration shaft 150 being connected to each other rotate clockwise together with the inner tub 120 connected to the dehydration shaft 150.

When the wash shaft 140 rotates counterclockwise, the eccentric shaft 250 moves toward the center of the wash shaft 140 and the inclined shaft 200 lies vertical with the same principal in an explanation of the operating process according to the first embodiment of the present invention. In the state that the inclined shaft 200 is in vertical position and the eccentric shaft 250 is supported by the first stopper 172; the inclined shaft 200 in vertical position rotates together with the rotation of the wash shaft 140. In this instance, as illustrated in FIG. 6, the wobbler guide 210 being inserted between the top guide 300*a* and the bottom guide 300*b* supports the inclined shaft 200 rotating at the same place without changing its location.

The second embodiment of the present invention explained above is usefully used when the intersecting point of the extension line of the center axis of the wash shaft 140 and the extension line of the center axis of the inclined shaft 200 is designed to locate above the wobbler 500 according to the inclination angle of the inclined shaft 200. That is, in the case above, because it is difficult to install the ball joint and the supporter above the wobbler 500, the wobbler guide 210, the top guide 300*a*, and the bottom guide 300*b* are formed to guide the inclined shaft 200 as in the second embodiment of the present invention.

Figure 8:
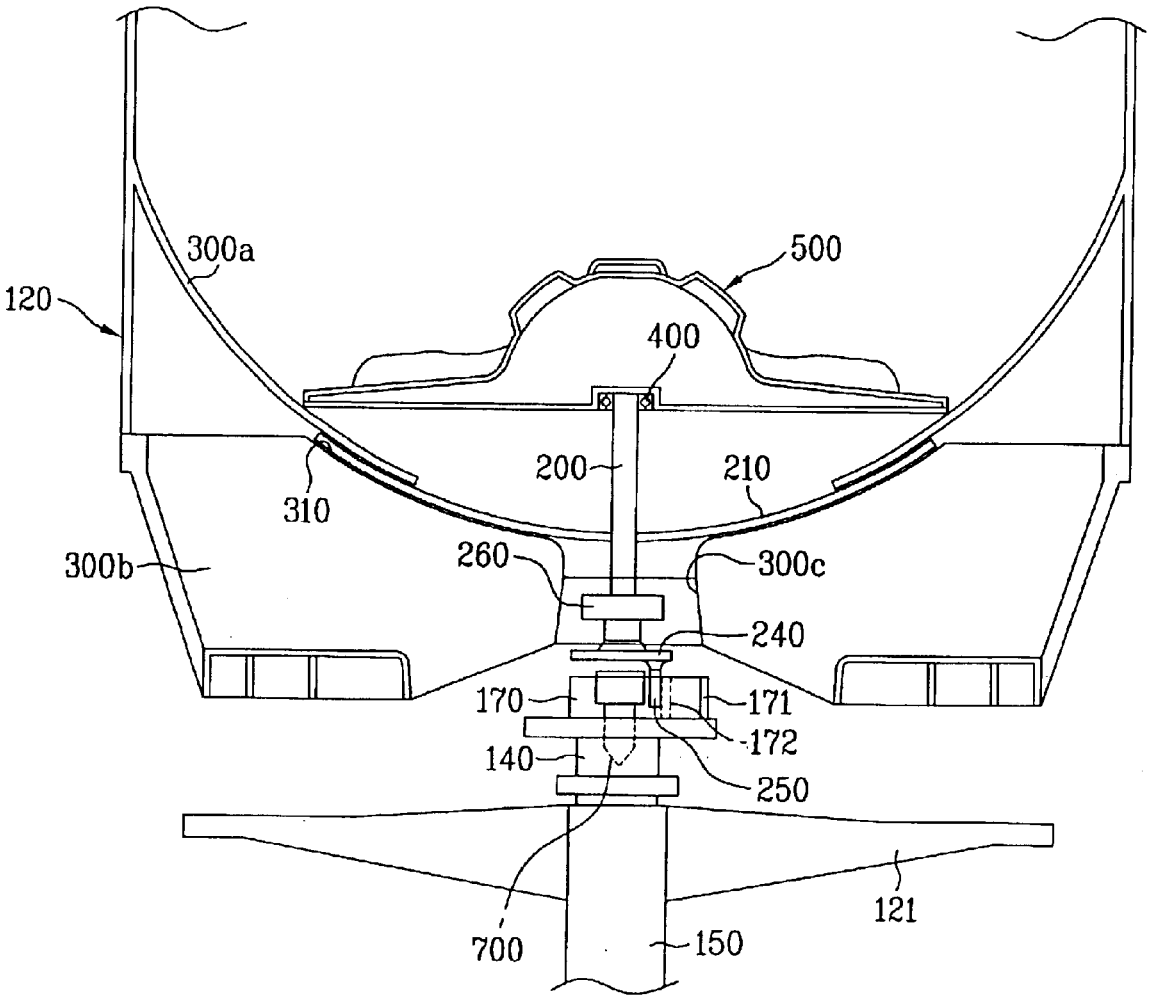
FIG. 8 illustrates a cross-sectional view of the horizontal wobbler according to a third embodiment of the present invention.

On the other hand, FIG. 8 illustrates a technical characteristic of a third embodiment of the present invention. A composition of the third embodiment of the present invention, as illustrated in FIG. 8, is similar to the second embodiment of the present invention explained with reference of FIGS. 5–7. But, in the third embodiment of the present invention, the inclined shaft guide to limit the inclination angle of the inclined shaft 200 and a supporter to install the inclined shaft guide are not separately provided. Instead, the bottom guide 300*b* plays the roles of the inclined shaft guide and the supporter together. That is, as illustrated in FIG. 8, a diameter of a hole on the bottom guide 300*b*, the hole through which the inclined shaft 200 passes, is formed as small as the inside diameter of the inclined shaft guide 600 in the second embodiment of the present invention, and also an inner circumferential surface 300*c* of the hole is formed in inclined position so that the diameter of the upper inner circumferential surface 300*c* of the hole is bigger than that of the lower inner circumferential surface 300*c* of the hole.

When the bottom guides 300*b* is formed as above, the boss 260 of the inclined shaft 200, the boss 260 being supported by and being attached to the inner circumferential surface 300*c* of the hole, limits the inclination angle of the inclined shaft 200 guiding the rotation of the inclined shaft 200. Thus, the number of parts is decreased, the manufacture is easy, and the cost of production is reduced. Also, the guide surface 310 stably guides the wobbling of the wobbler 500 because the hole, through which the inclined shaft 200 passing, is formed small, and the area of the guide surface 310 supporting and guiding the bottom of the wobbler guide 210 becomes broad.

Even though a few embodiments of the present invention are explained above, it will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

For example, to prevent friction between the wobbler 500 and the inclined shaft 200 during washing, it makes no difference to install one-way clutch instead of a journal or a ball bearing installed at an upper end of the inclined shaft 200.

That is, if installed a one-way clutch, only the inclined shaft 200 rotates during washing, the inclined shaft 200 rotates together with the wobbler 500 during dehydration, and reduces friction between laundries and the wobbler 500. A roller clutch is generally applied for the one-way clutch, and another thing in different form such as a sprag clutch can be used besides the one-way clutch as long as it performs the same operation.

For a reference, the roller clutch, a kind of one-way clutch, is shaped in spherical form and includes an outer race having a ramp on the inner circumferential surface, a roller distributed along the circumference on a parallel line of the shaft in the outer race, and an inner race for supporting the roller.

Also, in the embodiments of the present invention, it makes no difference that the second stopper 171 formed at an end of the rotation guide 170 located far from the center of the wash shaft 140 is not provided.

In this case, when the dehydration mode is changed to the washing mode and the wash shaft 140 rotates clockwise, the eccentric shaft 250 formed at the bottom of the inclined shaft 200 is located in the rotation guide 170 at first and enters into the outer circumferential surface of the rotation guide 170, located adjacent to the center axis of the wash shaft 140, deviating out of the rotation guide 170. After that, the eccentric shaft 250 moving along the outer circumferential surface of the rotation guide 170 stops at a certain point not proceeding any more. Like this, the reason why the eccentric shaft stops moving along the outer surface of the rotation guide 170 is that the inclination angle of the inclined shaft 200 is limited by the inclined shaft guide 600, the flat section of the rotation guide 170 is formed in spiral form, and the inclined shaft 200 is interfered by the inner surface of the inclined shaft 200 and the outer surface of the rotation guide 170 at a certain point.

On the other hand, when the washing mode is changed to the dehydration mode, the rotation guide 170 rotates in opposite direction, the eccentric shaft 250 located on outer surface of the rotation guide 170 enters into the inner circumferential surface of the rotation guide 170 stopped by the first stopper 172, and the inclined shaft 200 in vertical position rotates.

In the mean time, the washing machine according to the present invention can be formed to transmit power to both the wash shaft and the dehydration shaft by operating clutch assembly during washing. Composed as this, when operating washing, the inner tub rotates together so as to make strong and various water currents and improve the washing efficiency.

Hence, the embodiment explained above should be considered not limited but exemplified. Thus, it is intended that the present invention covers the modifications and variations of this invention provided they come within the scope of the appended claims and their equivalents.

The present invention has the following advantages.

First, unlike the conventional pulsator washing machine the rotation movement of the motor changes to the wobbling movement of the wobbler, and the movement of laundries is in direction of up and down and protects laundries from being twisted.

Second, during dehydration, the wobbler automatically remains horizontal, releases unbalance of the dehydration shaft and the inner tub rotating at high speed, and protects laundries from being damaged by unbalance.

Third, the energy by the movement of the wobbler is not used to twist and damage laundries but is concentrated to the needed place so as to heighten the efficiency of energy and the reliability of the product in the end.

What is claimed is:

1. A washing machine comprising:

a cabinet;

an outer tub provided in the cabinet;

an inner tub rotatably provided in the outer tub;

a wobbler provided in the inner tub;

a cylindrical dehydration shaft passing through the outer tub and being connected to a bottom of the inner tub;

a wash shaft passing through inside of the dehydration shaft and the bottom of the inner tub;

a motor rotating the wash shaft in a direction or in an opposite direction;

a clutch assembly; operated according to a signal of a control unit, selectively transmitting rotating force of the wash shaft to the dehydration shaft;

a rotation guide having a flat section in spiral form, the guide being projected on an upper end of the wash shaft;

an inclined shaft having a top end being coupled to the wobbler and a bottom end being supported by an inner circumferential surface of the rotation guide, the rotation guide rotating the bottom end of the inclined shaft about a center axis of the wash shaft and wobbling the wobbler during the rotation of the wash shaft; and guiding means for supporting the inclined shaft and for guiding rotation of the inclined shaft.

2. The washing machine of claim 1, wherein, the rotation guide comprises a first stopper and a second stopper being bended toward the inner circumferential surface and being extended to both ends of the guide.

3. The washing machine of claim 1, wherein, the inclined shaft comprises an eccentric shaft having a small diameter relative to the inclined shaft, the eccentric shaft extending eccentrically to a center axis of the inclined shaft at the lower end of the inclined shaft, having an end being in contact with and being supported by the inner surface of the rotation guide, and guiding rotation of the inclined shaft.

4. The washing machine of claim 3, wherein, the inclined shaft further comprises an expansion unit having a diameter greater than that of the inclined shaft, the expansion unit being provided at the bottom end of the inclined shaft; the eccentric shaft being fixed on an edge of a bottom surface of the expansion unit.

5. The washing machine of claim 1, further comprising a bearing being provided between the top end of the inclined shaft and the wobbler for preventing friction there-between and preventing the top end of the inclined shaft and the wobbler from rotating with each other.

6. The washing machine of claim 1, wherein, the inner tub comprises an inclined shaft guide being provided at a lower inside of the inner tub, the inclined shaft passing through the inclined shaft guide, which limits an inclination angle of the inclined shaft.

7. The washing machine of claim 6, further comprising a boss being provided around an outer surface of the inclined shaft, and being in contact with an inside surface of the inclined shaft guide to limit the inclination angle of the inclined shaft.

8. The washing machine of claim 6, wherein, an inner circumferential surface of the inclined shaft guide has an inner circumferential surface such that a bottom circumference of the inner circumferential surface is greater than a top circumference of the inner circumferential surface.

9. The washing machine of claim 6, wherein, the inclined angle of the inclined shaft is in a range of 1°–10° with respect to the center axis of the wash shaft.

10. The washing machine of claim 1, wherein the guiding means comprises a ball joint provided around the inclined shaft, the ball joint being rotatably coupled to a bottom of the inner tub.

11. The washing machine of claim 10, wherein, the guiding means further comprises a supporter, through which the inclined shaft passing, which stably supports the ball joint, extends in the lower part of the inner tub.

12. The washing machine of claim 11, wherein, the supporter comprises spherical grooves, each being in contact with the surface of the ball joint and supporting the ball joint.

13. The washing machine of claim 1, wherein, a lower circumferential surface of the inner tub is in a spherical form for maintaining a predetermined minimal distance from a circumferential end of the wobbler so as to prevent laundries from being jammed during wobbling of the wobbler.

14. The washing machine of claim 1, the guiding means comprises:

a wobbler guide in a bowl form provided around the outer circumferential surface of the inclined shaft; and a lower part guide provided in a lower inside of the inner tub, the lower part guide supporting a bottom surface of the wobbler guide and guiding the rotation of the inclined shaft.

15. The washing machine of claim 14, wherein, the lower part guide comprises a guiding surface attached to the bottom surface of the wobbler guide, the lower part guide having a spherical surface for guiding the rotation of the inclined shaft smoothly.

16. The washing machine of claim 14, wherein, the guiding means further comprises an upper guide provided in a lower inside of the inner tub, the upper guide having a bottom surface in a bowl form to guide an upper surface of the wobbler guide and having a center through-hole, through which the inclined shaft passes.

17. The washing machine of claim 16, wherein, an upper surface of the upper guide is in a spherical form remaining a predetermined minimal distance with the circumferential end of the wobbler during wobbling of the wobbler for preventing laundries from being jammed.

18. The washing machine of claim 14, wherein, an inner circumferential surface of the lower part guide has an inner circumferential surface such that a bottom circumference of the inner circumferential surface is greater than a top circumference of the inner circumferential surface.

* * * * *

UNITED STATES PATENT AND TRADEMARK OFFICE

CERTIFICATE OF CORRECTION

PATENT NO. : 6,865,912 B2
DATED : March 15, 2005
INVENTOR(S) : K. H. Kim

It is certified that error appears in the above-identified patent and that said Letters Patent is hereby corrected as shown below:

Column 13,
Line 1, ";" should be -- , --.

Signed and Sealed this

First Day of November, 2005

JON W. DUDAS
*Director of the United States Patent and Trademark Office*